US010549528B2

(12) United States Patent
Sugiyama et al.

(10) Patent No.: US 10,549,528 B2
(45) Date of Patent: Feb. 4, 2020

(54) PRINTING APPARATUS

(71) Applicant: CANON KABUSHIKI KAISHA, Tokyo (JP)

(72) Inventors: Kenji Sugiyama, Kawasaki (JP); Toshiki Takeuchi, Tokyo (JP); Masato Izumi, Tokyo (JP); Kengo Nieda, Kawasaki (JP); Ippei Tsushima, Kawasaki (JP); Atsushi Sakamoto, Yokohama (JP); Futoshi Hirose, Yokohama (JP); Susumu Hirosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/030,114

(22) Filed: Jul. 9, 2018

(65) Prior Publication Data

US 2019/0016114 A1 Jan. 17, 2019

(30) Foreign Application Priority Data

Jul. 12, 2017 (JP) ..... 2017-136443

(51) Int. Cl.
*B41J 2/005* (2006.01)
*B41J 29/17* (2006.01)

(52) U.S. Cl.
CPC ..... *B41J 2/0057* (2013.01); *B41J 29/17* (2013.01)

(58) Field of Classification Search
CPC ..... B41J 29/17; B41J 2/0057; B41J 2/175
USPC ..... 347/22, 28, 32, 103
See application file for complete search history.

(56) References Cited

U.S. PATENT DOCUMENTS 7,901,030 B2 * 3/2011 Miyata ..... B41J 11/007 347/103
8,147,055 B2 * 4/2012 Cellura ..... B41J 2/0057 347/103
2019/0009516 A1 * 1/2019 Fukui ..... C09D 11/30

FOREIGN PATENT DOCUMENTS

JP H07-115468 B2 12/1995

OTHER PUBLICATIONS

Copending, unpublished U.S. Appl. No. 16/015,364 to Toshiki Takeuchi et al., filed Jun. 22, 2018.
Copending, unpublished U.S. Appl. No. 16/015,370 to Yuichiro Yanagi et al., filed Jun. 22, 2018.

* cited by examiner

*Primary Examiner* — An H Do
(74) *Attorney, Agent, or Firm* — Venable LLP

(57) ABSTRACT

According to an embodiment of this invention, a printing apparatus capable of cleaning a transfer member continuously while downsizing the apparatus and a cleaning method of the same are provided. The printing apparatus includes a cleaning roller configured to apply a cleaning liquid to the transfer member while rotating in contact with the transfer member, a liquid tank configured to reserve the cleaning liquid so that a part of the cleaning roller is immersed in the cleaning liquid, and a removal unit configured to remove a blot by contacting the surface of the cleaning roller which rotates in the liquid tank.

13 Claims, 11 Drawing Sheets

PRINTING APPARATUS

BACKGROUND OF THE INVENTION

Field of the Invention

The present invention relates to, for example, an inkjet printing apparatus that transfers, to a print medium, an image formed by discharging ink to a transfer member.

Description of the Related Art

There is an inkjet printing apparatus configured to form an image by discharging ink from a printhead to a rotating intermediate drum (transfer member), transfer the image to a print medium, and print the image. Such an apparatus needs an arrangement that cleans the transfer member in order to hold the transfer member in a satisfactory state.

Japanese Patent Publication No. 7-115468 discloses an arrangement that cleans the outer surface of a cylindrical body used in a printing machine. This arrangement cleans a blot of the cylindrical body by applying a liquid to the outer surface of the cylindrical body and wiping the applied liquid with a cleaning roller (wiping roller).

An apparatus disclosed by Japanese Patent Publication No. 7-115468 has an arrangement that scrapes off a blot on the surface of a rotating cleaning roller by bringing a doctor blade into contact with the cleaning roller. In a printing apparatus that performs high-speed continuous printing, however, blots may accumulate in the cleaning roller without keeping up with cleaning on the surface of the cleaning roller. Then, the cleaning roller fails to clean the transfer member, making it impossible to perform satisfactory image formation.

SUMMARY OF THE INVENTION

Accordingly, the present invention is conceived as a response to the above-described disadvantages of the conventional art.

For example, an inkjet printing apparatus according to this invention is capable of cleaning a transfer member satisfactorily even in high-speed continuous printing.

According to one aspect of the present invention, there is provided a printing apparatus comprising: a transfer member that rotates; a printhead configured to form an image on the transfer member; a transfer unit configured to transfer, to a print medium, the image formed on the transfer member; a cleaning roller which rotates in contact with the moving transfer member; a liquid tank configured to reserve a cleaning liquid so that a part of the cleaning roller is immersed in the cleaning liquid; and a removal unit configured to remove a blot by contacting a surface of the cleaning roller which rotates in the liquid tank.

The invention is particularly advantageous since an inkjet printing apparatus capable of cleaning a transfer member satisfactorily even in high-speed continuous printing is realized.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings. Note that arrows X and Y indicate the horizontal directions, respectively, the arrows X and Y are perpendicular to each other in each figure, and arrow Z indicates the vertical direction.

Description of Terms

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium. Note that this invention is not limited to any specific ink component, however, it is assumed that this embodiment uses water-base ink including water, resin, and pigment serving as coloring material.

Further, a "print element (or nozzle)" generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing System>

Figure 1:
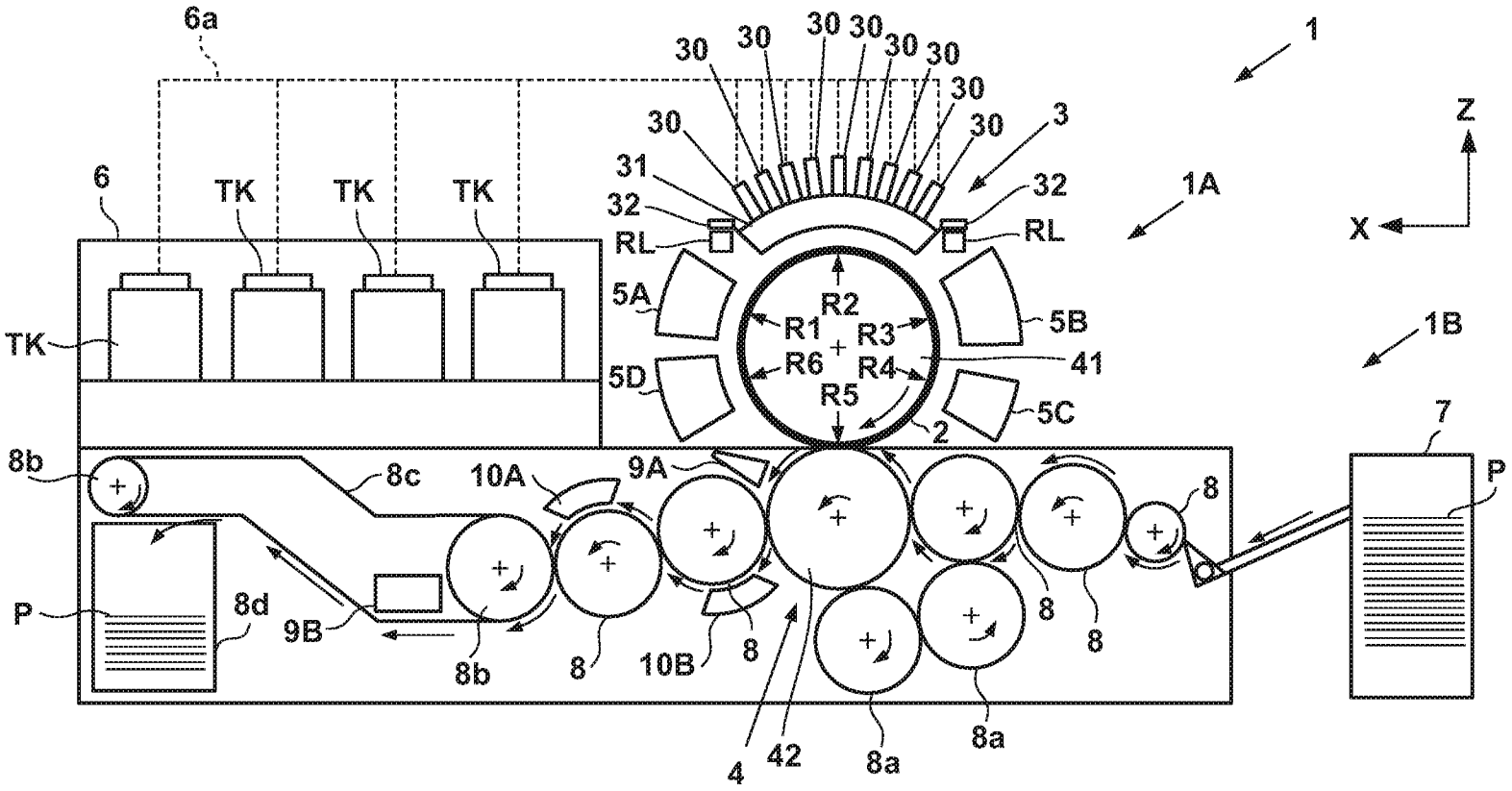
FIG. 1 is a schematic view showing a printing system according to an exemplary embodiment of the present invention.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

<Printing Apparatus>

The printing apparatus 1A includes a print unit 3, a transfer unit 4, peripheral units 5A to 5D, and a supply unit 6.

<Print Unit>

Figure 2:
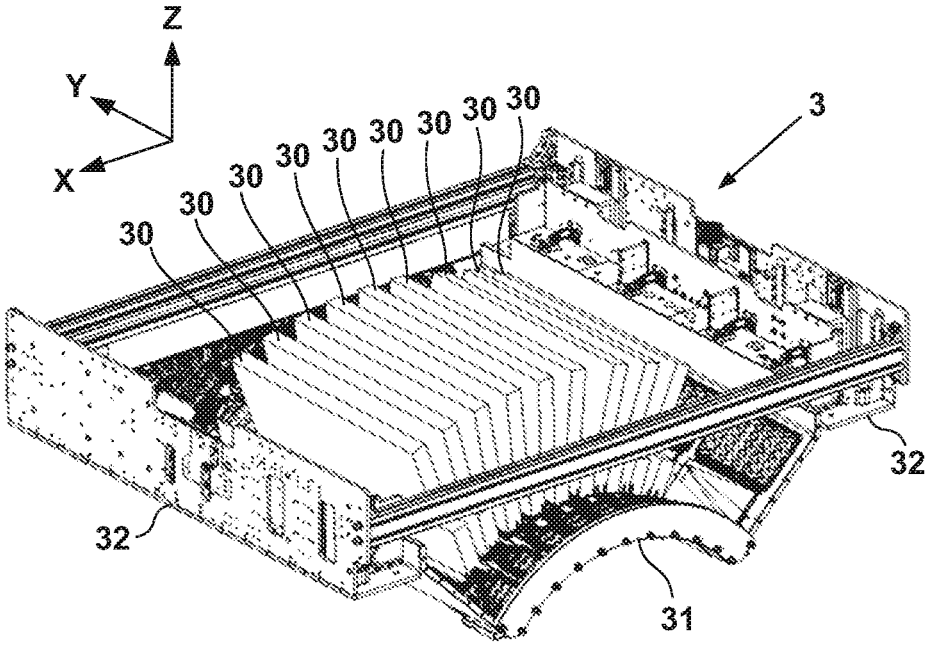
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member (intermediate transfer member) 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
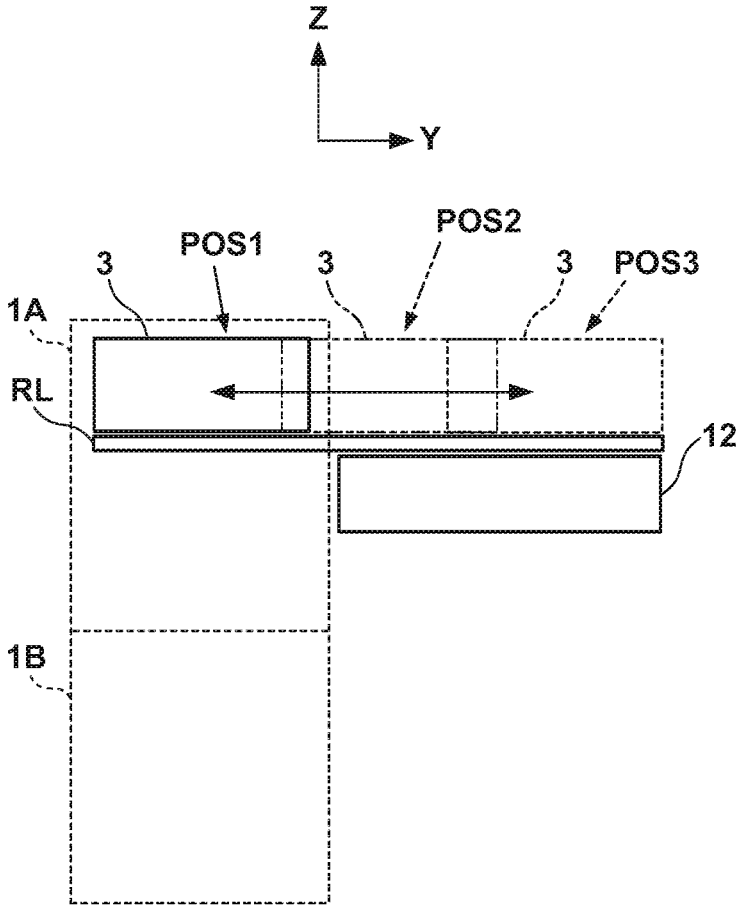
FIG. 3 is an explanatory view showing a displacement mode of the print unit in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism which caps the ink discharge surface of each printhead 30, a wiper mechanism which wipes the ink discharge surface, a suction mechanism which sucks ink in the printhead 30 by a negative pressure from the ink discharge surface can be given as such mechanisms.

The guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends dividedly into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials such as a resin and a ceramic can be used appropriately. In respect of durability or the like, however, a material high in compressive modulus can be used. More specifically, an acrylic resin, an acrylic silicone resin, a fluoride-containing resin, a condensate obtained by condensing a hydrolyzable organosilicon compound, and the like can be given. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like can be given as the surface treatment. A plurality of them may be combined. It is also possible to provide any desired surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials such as the resin and the ceramic can be used appropriately. In respect of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like can be given. In addition, ethylene propylene rubber, natural rubber, styrene rubber, isoprene rubber, butadiene rubber, the copolymer of ethylene/propylene/butadiene, nitrile-butadiene rubber, and the like can be given in particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source such as a motor that drives them. A driving force can be delivered by a transmission mechanism such as a gear mechanism.

<Peripheral Unit>

The peripheral units 5A to 5D are arranged around the transfer drum 41. In this embodiment, the peripheral units 5A to 5D are specifically an application unit, an absorption unit, a heating unit, and a cleaning unit in order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism which absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, cooling functions of the transfer member 2 may be applied, or cooling units may be added to these units. In this case, the cooling units may be a blowing mechanism that blows to the transfer member 2, a mechanism in which a member (for example, a roller) contacts the transfer member, and the member is cooled down by an air-cooled or liquid-cooled method, or a mechanism that cools down the cleaning member of the cleaning unit 5D. The cooling timing may be a period after transferring the image and before applying the reactive liquid.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing includes, for example, coating that aims at protection, glossy, and the like of an image on the image printed surface of the printed product P'. For example, liquid application, sheet welding, lamination, and the like can be given as an example of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
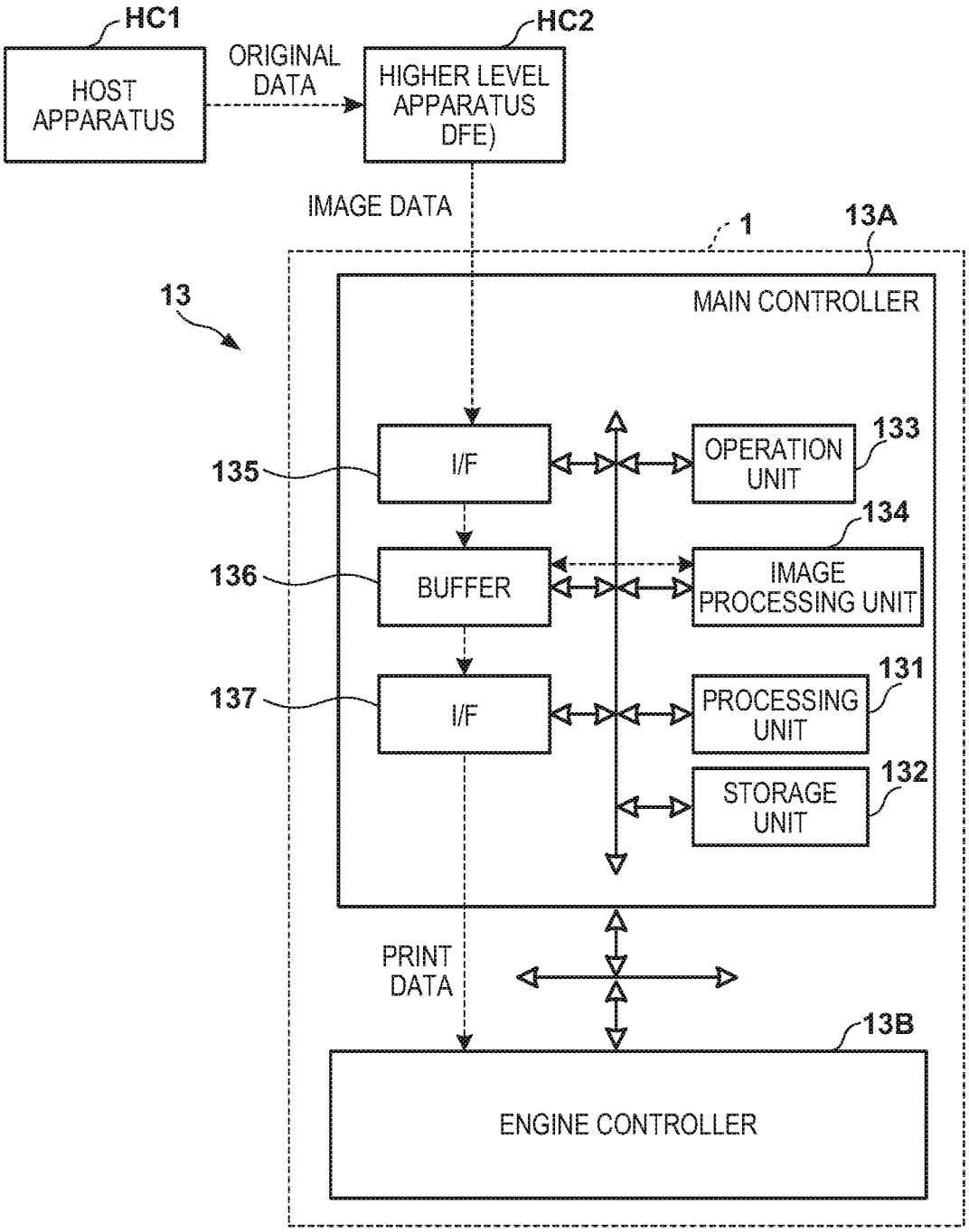
FIG. 4 is a block diagram showing a control system of the printing system in FIG. 1.
Figure 5:
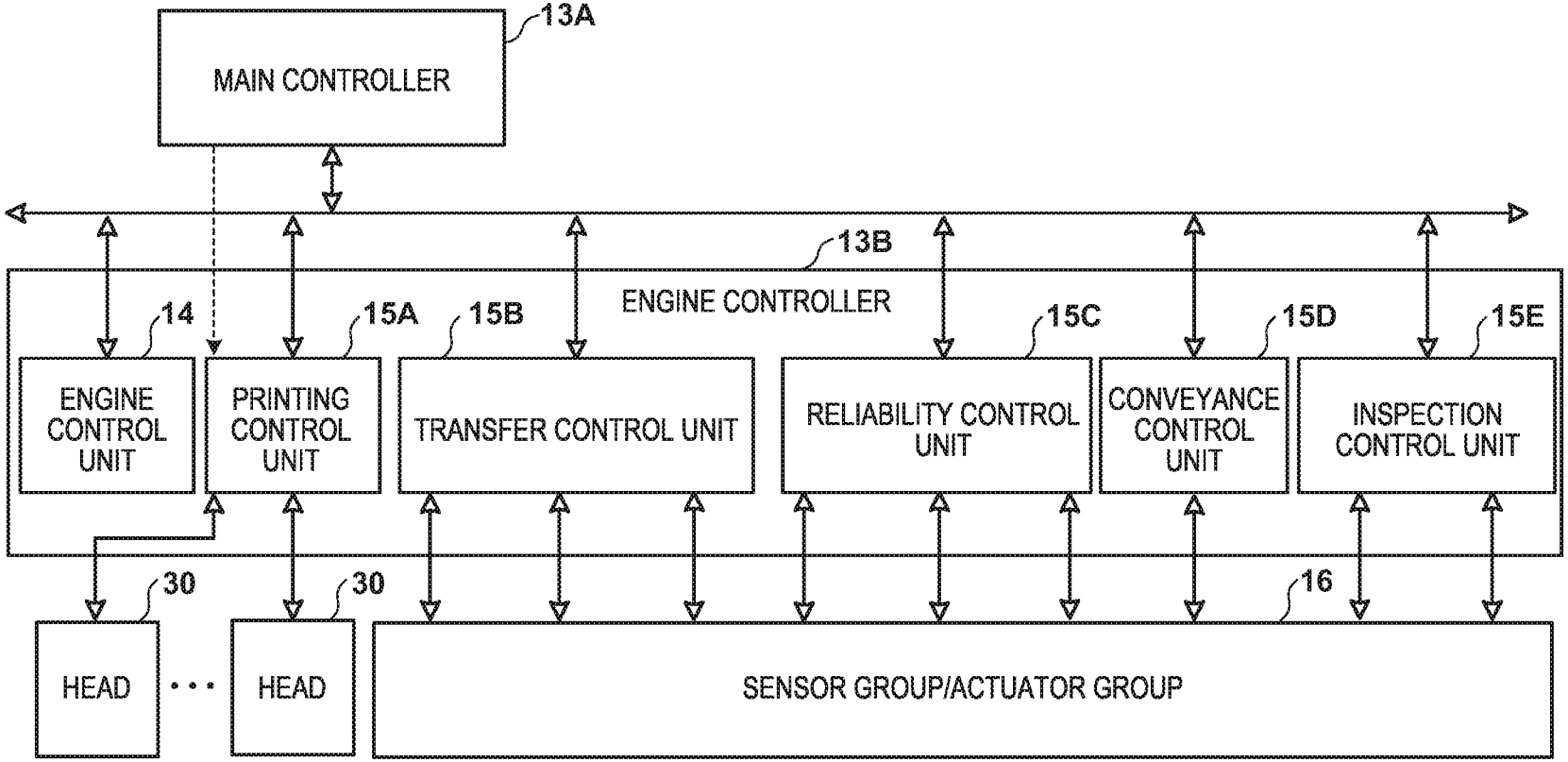
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

The host apparatus HC1 may be, for example, a PC (Personal Computer) serving as an information processing apparatus, or a server apparatus. A communication method between the host apparatus HC1 and the higher level apparatus HC2 may be, without particular limitation, either wired or wireless communication.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. An external storage unit may further be provided in addition to the storage unit 132. The operation unit 133 is, for example, an input device such as a touch panel, a keyboard, or a mouse and accepts a user instruction. The operation unit 133 may be formed by an input unit and a display unit integrated with each other. Note that a user operation is not limited to an input via the operation unit 133, and an arrangement may be possible in which, for example, an instruction is accepted from the host apparatus HC1 or the higher level apparatus HC2.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes an engine control units 14 and 15A to 15E, and obtains a detection result of a sensor group/actuator group 16 of the printing system 1 and controls driving of the groups. Each of these control units includes a processor such as a CPU, a storage device such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism which moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

<Operation Example>

Figure 6:
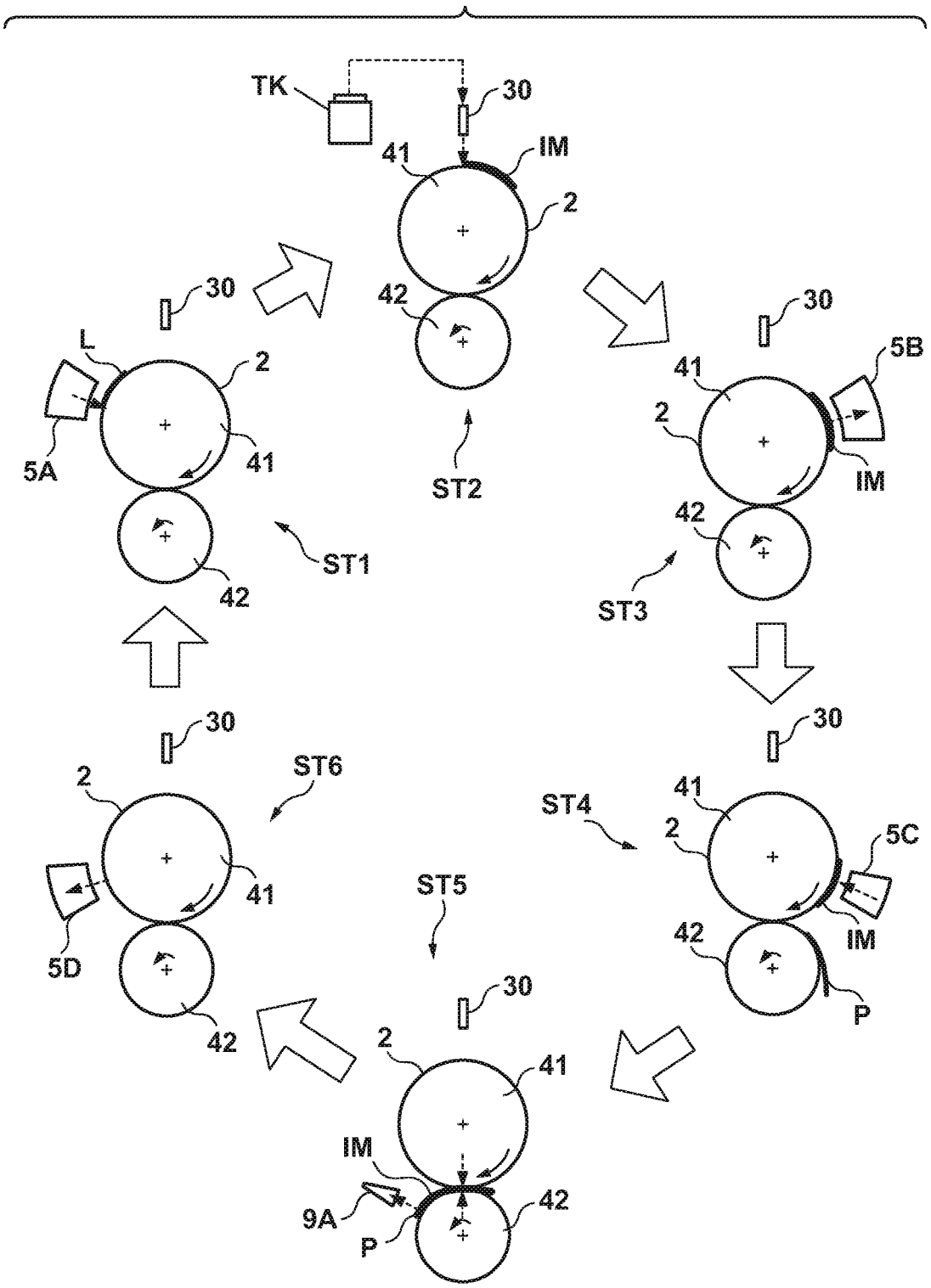
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Each printhead 30 needs maintenance if such a printing operation continues.

Figure 7:
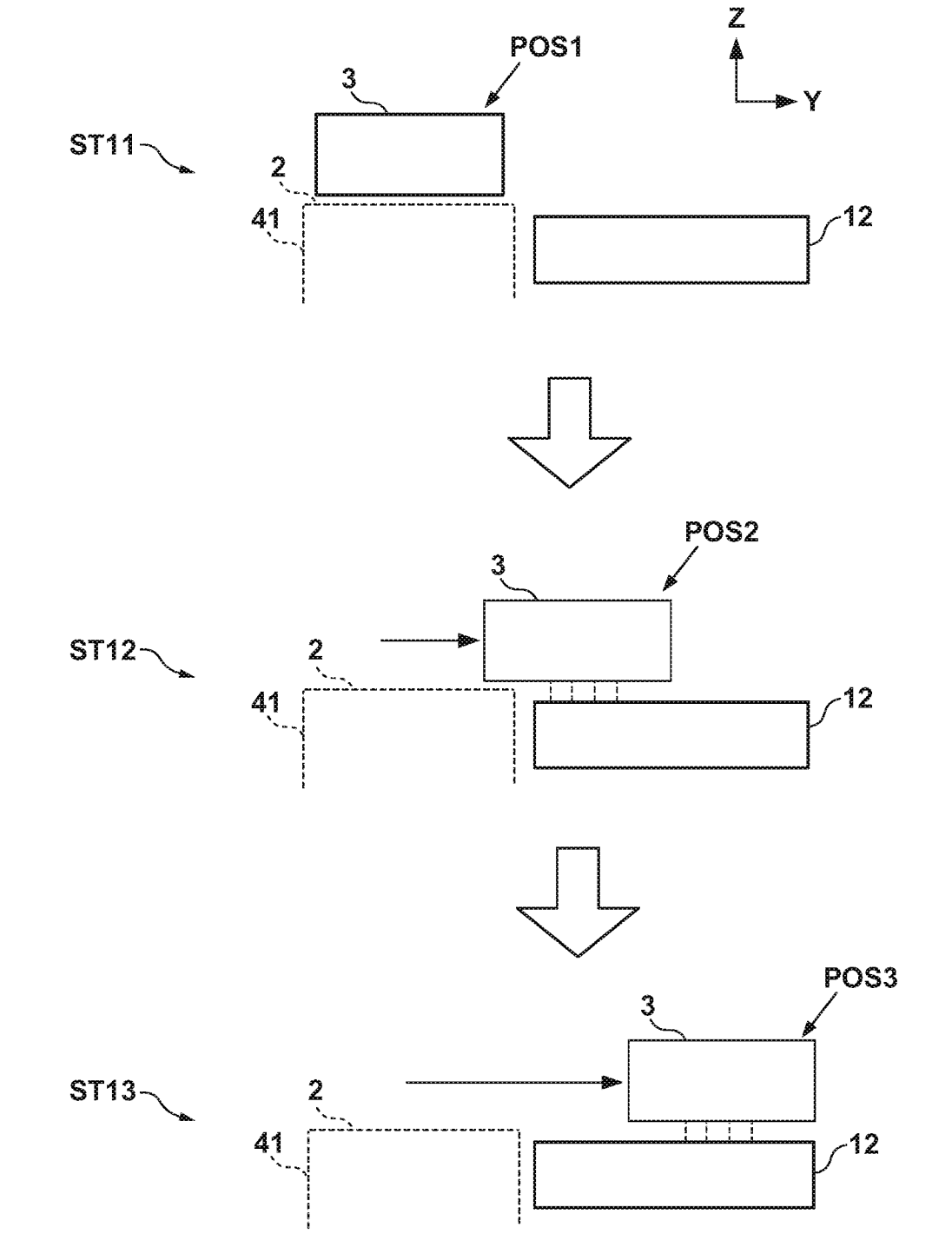
FIG. 7 is an explanatory view showing an example of the operation of the printing system in FIG. 1.

FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

A cleaning operation performed by the cleaning unit 5D arranged around the transfer member in the printing system having the above arrangement will be described next.

<Detailed Description of Cleaning Unit 5D>

Figure 8:
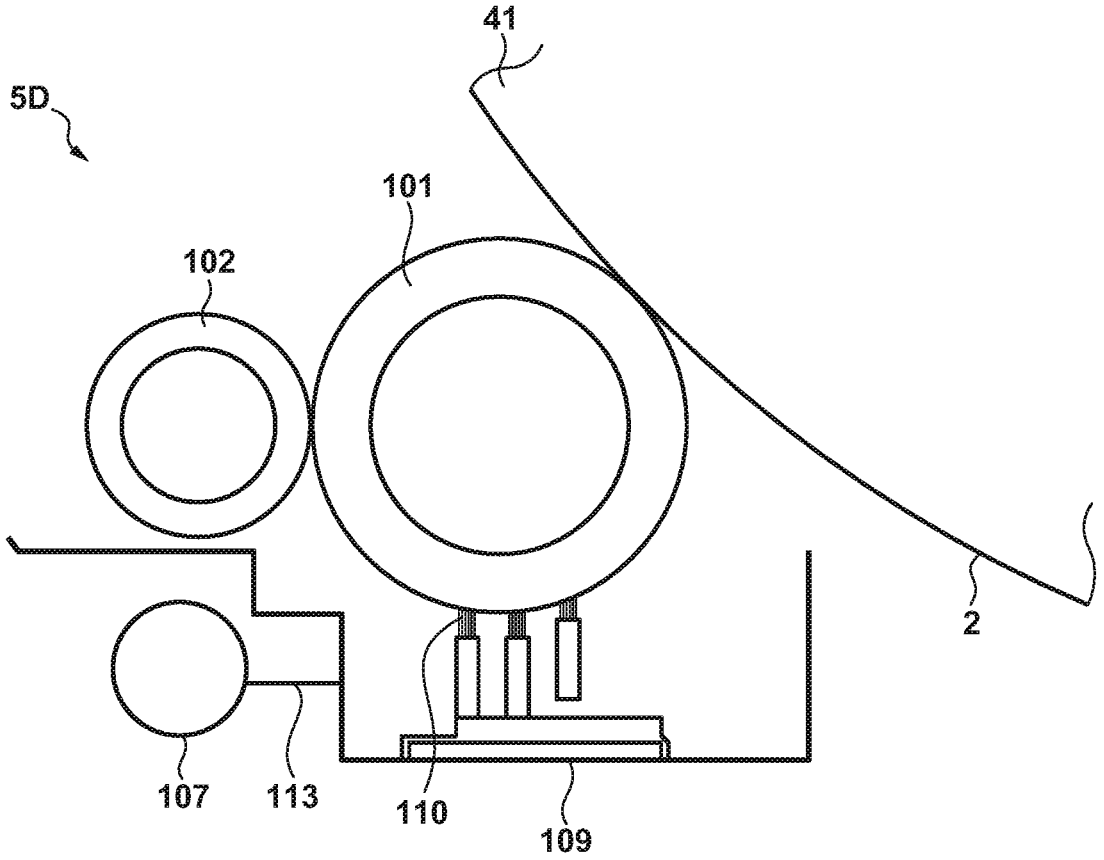
FIG. 8 is an enlargement side sectional view showing the detailed arrangement of the cleaning unit.

FIG. 8 is an enlargement side sectional view showing the detailed arrangement of the cleaning unit. The cleaning unit 5D includes a cleaning roller 101 that wipes the transfer member 2 provided in contact with the outer surface of the transfer drum 41 and brushes 110, a liquid tank 109, and a liquid amount adjustment roller (driven roller) 102 arranged in the circumference of the cleaning roller 101. The brushes 110 are provided inside the liquid tank 109. A fluid channel 113 for a liquid in the liquid tank 109 to circulate externally is provided. A pump 107 (not shown in FIG. 8) to be described later is connected to the fluid channel 113. Then, the pump 107 is always operated during an image printing operation to circulate the liquid inside the liquid tank 109. Furthermore, a filter (to be described later) is provided in a channel that circulates the liquid in order to collect uncleanness in the liquid. The cleaning roller 101 is arranged such that the lower portion of the roller is immersed in the liquid in the liquid tank 109 to be submerged.

A porous sheet-shaped member and spongy member are wound around the outer peripheral portion of the cleaning roller 101, allowing these members to hold a liquid. The liquid amount adjustment roller 102 contacts the cleaning roller 101 and forms a nip portion. The liquid amount adjustment roller 102 presses a porous member, and a contact control mechanism (not shown) controls a pressing force of the liquid amount adjustment roller 102. An amount obtained by crushing the porous member is changed by this pressing, adjusting a liquid amount held by the cleaning roller 101. A rotation direction of the cleaning roller 101 is the same as a rotation direction (clockwise) of the transfer member 2, and they move in opposite directions in a contact portion, increasing a relative speed. That is, in the contact portion between the transfer member 2 and the cleaning roller 101, a moving direction on the surface of the cleaning roller 101 is reversed with respect to a moving direction on the surface of the transfer member 2. Consequently, dirt hardly remains in the nip portion of the cleaning roller 101 and the transfer member 2, improving a cleaning effect.

As described above, a blot attached to the surface of the transfer member is removed while applying the liquid to the transfer member 2 by the cleaning roller 101. Then, a blot of the cleaning roller 101 itself is also removed by the brushes 110 in the liquid of the liquid tank 109. That is, the lower portion of the rotating cleaning roller 101 is immersed in the liquid of the liquid tank 109, and the surface of the cleaning roller 101 passes through the brushes 110 located under a liquid level, removing the blot attached to the roller surface. Simultaneously with this blot removal, a liquid (cleaning liquid: CL liquid) is newly applied to the cleaning roller 101. The blot removed by the brushes 110 is collected by circulating the liquid. The liquid in the liquid tank 109 is maintained at a purity level at which it can be applied to the cleaning roller 101.

A liquid amount held by the cleaning roller 101 is adjusted to a desired value by adjusting the pressing force of the liquid amount adjustment roller 102 in contact with the cleaning roller 101. Note that the liquid amount held by the cleaning roller 101 may be adjusted not by using the liquid amount adjustment roller 102 but by, for example, pressing the cleaning roller 101 with a blade or the like, or blowing air. Further, a removal unit that removes a blot by contacting the cleaning roller 101 is not limited to the brush 110, and the blot may be scraped off by using a contact member such as a blade or a wiper. Furthermore, the removal unit may not necessarily adopt a form in which the blot is scraped off by contacting the roller surface immersed under the liquid level of the liquid tank 109 and may adopt a form in which the contact member contacts the surface of the rotating roller above the liquid level to remove the blot.

By repeating the above-described operation, it is possible to clean the transfer member 2 continuously and stably during the printing operation.

Figure 9:
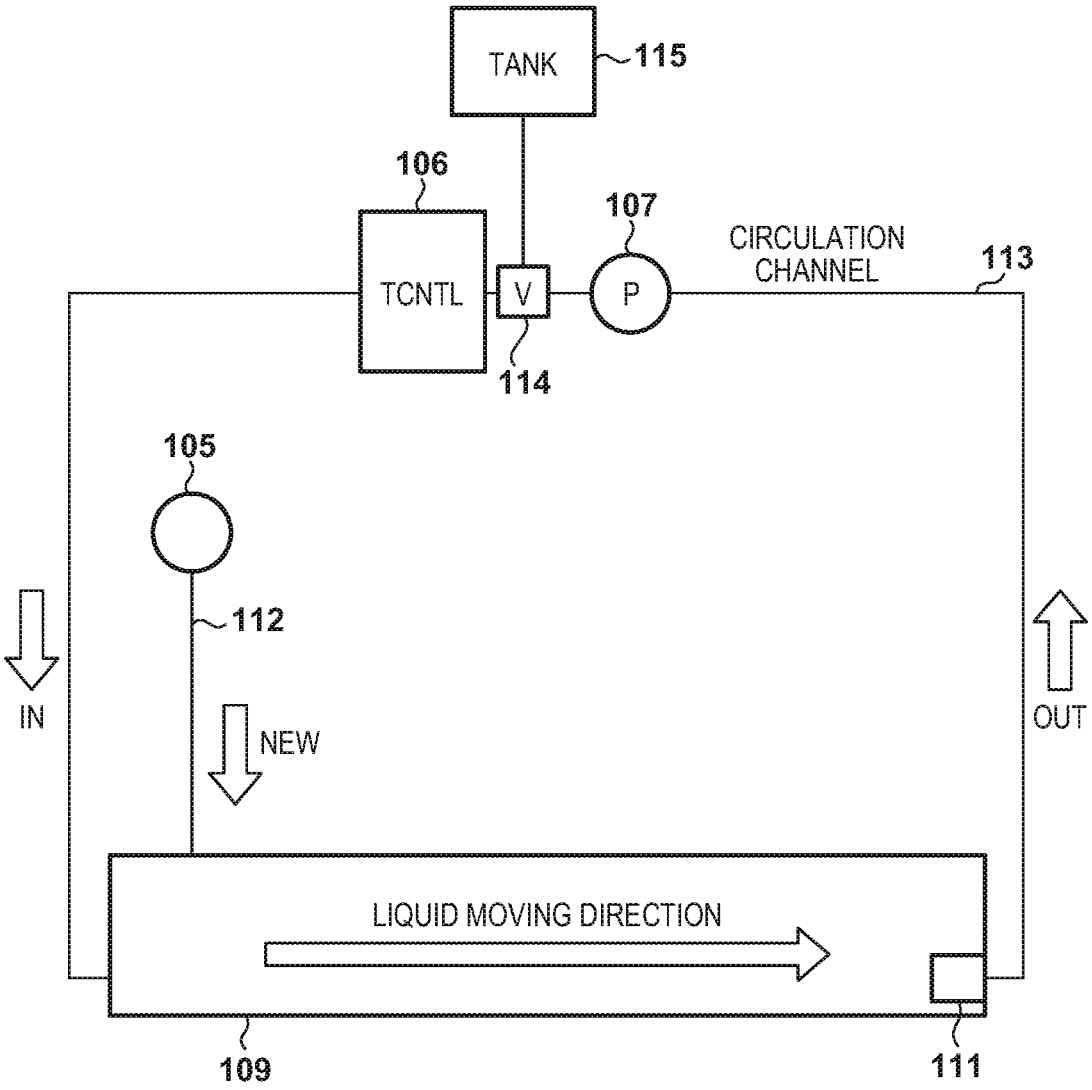
FIG. 9 is a block diagram showing the arrangement showing a liquid circulation and liquid temperature adjustment.

FIG. 9 is a block diagram showing the arrangement of a circulation channel where a liquid circulation and liquid temperature adjustment are performed. The liquid (cleaning liquid: CL liquid) of the liquid tank 109 moves to the pump (P) 107 and a temperature adjustment unit (TCNTL) 106 via the fluid channel 113, and returns to the liquid tank 109 again via the fluid channel 113. Here, a channel from the liquid tank 109 to the pump 107 and the temperature adjustment unit (TCNTL) 106 is indicated as an OUT (outflow), and a channel that returns to the liquid tank 109 from the pump 107 and the temperature adjustment unit (TCNTL) 106 is indicated as an IN (inflow). The cleaning roller 101 applies the cleaning liquid (CL liquid) to the transfer member 2 by a cleaning operation, and thus the cleaning liquid in the liquid tank 109 decreases gradually. Therefore, the cleaning liquid is supplied from a liquid supply unit 105 to the liquid tank 109 via a fluid channel (NEW) 112 different from the fluid channel 113. The liquid supply unit 105 is formed by a tank, a pump, a valve, or the like. A three-way valve 114 is provided between the pump 107 and the temperature adjustment unit 106. A fluid channel leading to a waste liquid tank (TANK) 115 is connected to one connection port of the three-way valve (V) 114. By switching the three-way valve 114, it is possible to obtain one of a normal state (first state) in which a liquid flows from the pump 107 to the temperature adjustment unit 106, and a collection state (second state) in which the liquid is exhausted and collected from the pump 107 to the waste liquid tank 115.

When the pump 107 is driven, a flow occurs inside the liquid tank 109 in a direction indicated by an arrow of FIG. 9, moving the liquid. Then, a circulation channel where the liquid flows out of the liquid tank 109 in the direction of an arrow OUT, and the liquid flows into the liquid tank 109 in the direction of an arrow IN is formed. In general, the three-way valve 114 is in the normal state, and the circulation channel is maintained. On the other hand, when the liquid is to be withdrawn from the circulation channel during a non-use period, at the time of maintenance, or the like of an apparatus, it is possible to exhaust the liquid from the inside of the circulation channel to the waste liquid tank 115 by switching the three-way valve 114 to the collection state to drive the pump 107. Note that an arrangement may be adopted in which the liquid is exhausted from the circulation channel on the upstream side of the pump 107 by providing an exhausting pump different from the pump 107.

In the liquid circulation, the liquid passes through a filter 111 provided near an outlet of the liquid tank 109 when flowing out the liquid from the liquid tank 109, collecting uncleanness owing to an impurity such as a foreign substance in the liquid by the filter 111. Therefore, the liquid is always held in a state in which uncleanness is removed through this circulation. Note that the filter 111 may be provided in an inlet of the liquid tank 109, or one or the plurality of filters 111 may be provided at any desired positions in the circulation channel. Depending on the size of a target to be removed, a microfiltration membrane, an ultrafiltration membrane, an ion-exchange membrane, a reverse osmosis membrane, or the like may be use as the filter 111. Particularly, the ultrafiltration membrane is preferable.

Furthermore, the liquid passes through the temperature adjustment unit 106 in the liquid circulation, and the temperature adjustment unit 106 performs temperature adjustment so as to set the liquid at a proper temperature. Hence, the liquid that has undergone temperature adjustment returns to the liquid tank 109. Therefore, the liquid is always held in a state in which a temperature is adjusted properly through this circulation.

The above-described liquid circulation and temperature adjustment are performed during the printing operation. The transfer control unit 15B is in charge of the execution control.

The operation of the cleaning unit 5D during the printing operation will be described next in more detail.

<Operation of Cleaning Unit 5D (FIGS. 10A to 11B)>

FIGS. 10A to 11B are views each showing the operation of the cleaning unit 5D. Note that the three-way valve 114 provided between the pump 107 and the temperature adjustment unit 106 is not shown in FIGS. 10A to 11B.

Figure 10A:
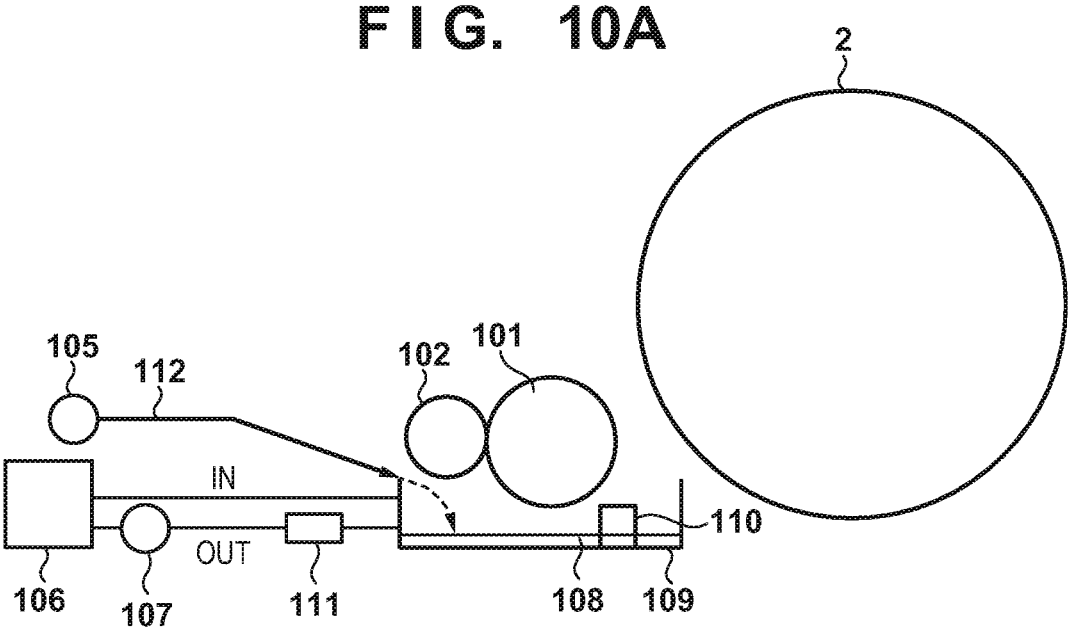
FIGS. 10A to 10B are enlargement side sectional views each showing the detailed arrangement of the cleaning unit.

When the printing system 1 is activated, a new cleaning liquid is supplied from the liquid supply unit 105 to the liquid tank 109 via the fluid channel 112, as shown in FIG. 10A. At this time, the transfer member 2, the cleaning roller 101, and the liquid amount adjustment roller 102 do not rotate, and the cleaning operation is not started yet. The pump 107 and the temperature adjustment unit (TCNTL) 106 start operations along with supply of the cleaning liquid, circulating the cleaning liquid. Consequently, the supplied cleaning liquid is adjusted to an appropriate temperature.

Because the cleaning operation is not started yet, the amount of a cleaning liquid 108 in the liquid tank 109 is not so large, and the purity level of the cleaning liquid at this time is held satisfactorily.

Figure 10B:
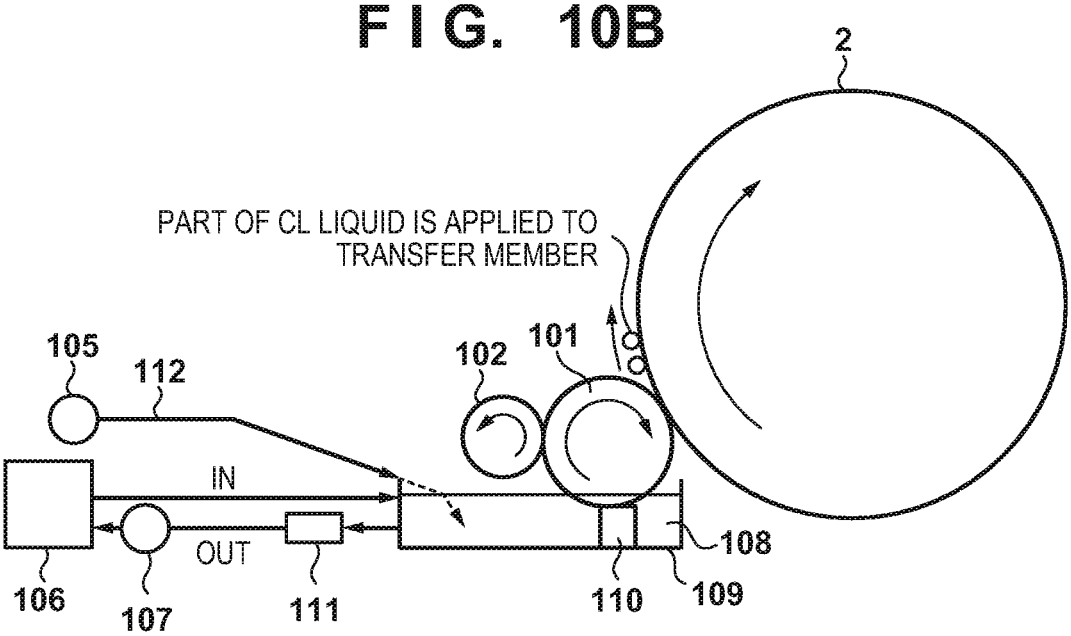

When the printing operation is prepared, the cleaning liquid is further supplied from the liquid supply unit 105 to the liquid tank 109 via the fluid channel 112, as shown in FIG. 10B. Along with this, the level of the cleaning liquid in the liquid tank 109 increases. Further, the cleaning roller 101 contacts the transfer member 2, and the transfer member 2 and the cleaning roller 101 rotate in opposite directions at the contact position. Consequently, a part of the cleaning liquid (CL liquid) is applied to the surface of the transfer member 2 via the cleaning roller 101. Furthermore, the liquid amount adjustment roller 102 that rotates in the same direction as the cleaning roller 101 contacts the cleaning roller 101, forms a nip portion, and adjusts a liquid amount obtained by impregnating the cleaning roller 101 with a nip pressure.

At this time, the cleaning roller 101 contacts the transfer member 2, and thus heat of the transfer member 2 is conducted to the cleaning roller 101, increasing the temperature of the cleaning liquid 108 in the liquid tank 109. A cooling capability by the temperature adjustment unit (TCNTL) 106 is controlled to perform temperature adjustment, handling a rising trend in temperature of the cleaning liquid. The brush 110 is in contact with the cleaning roller 101. Preparation for the printing operation is completed after the above operation.

Figure 11A:
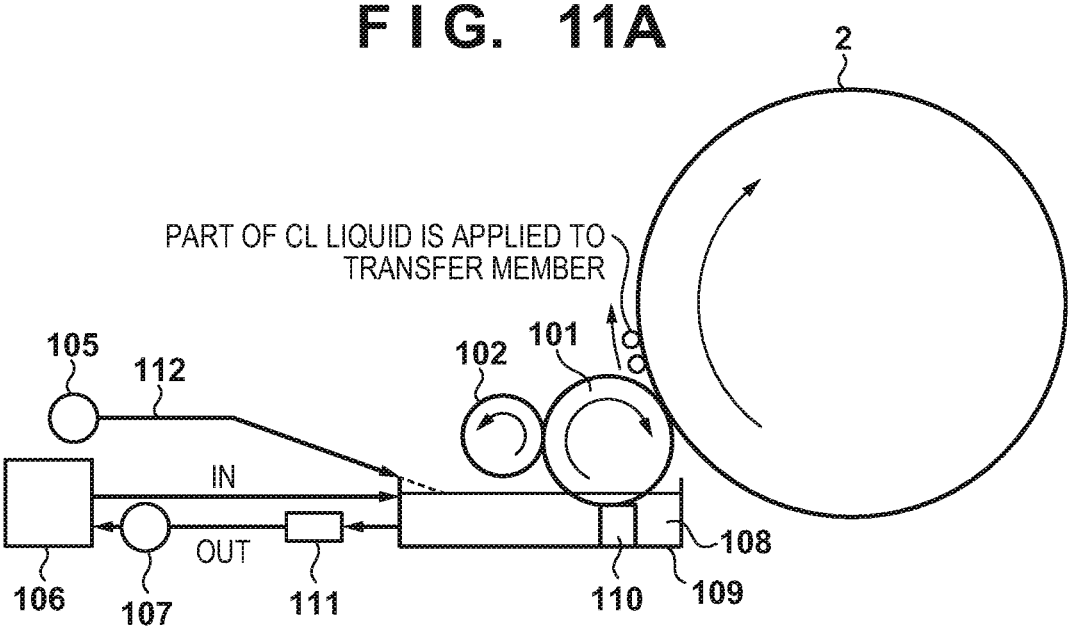
FIGS. 11A to 11B are views each showing the operation of the cleaning unit.

During the printing operation and till the end of printing, the cleaning liquid is continuously supplied from the liquid supply unit 105 to the liquid tank 109 via the fluid channel 112, as shown in FIG. 11A. On the other hand, the cleaning roller 101 consumes the cleaning liquid, and thus the cleaning liquid is newly supplied from the liquid supply unit 105 to such an extent that the level of the cleaning liquid in the liquid tank 109 is maintained. In order to maintain the purity level of the cleaning liquid in the liquid tank 109 satisfactorily and the temperature of the liquid appropriately, the pump 107 and the temperature adjustment unit (TCNTL) 106 continue the operations, circulate the cleaning liquid, and perform temperature adjustment such that the temperature of the cleaning liquid falls within a predetermined target temperature range.

During the printing operation and till the end of printing, the cleaning roller 101 always contacts the transfer member 2, making it possible to continuously wipe and clean the transfer member 2 by applying the cleaning liquid from the cleaning roller 101 and rotating the cleaning roller 101 itself.

At this time, the brush 110 is held in a state in which it contacts the cleaning roller 101. The cleaning roller 101 rotates continuously, removing uncleanness owing to an impurity such as a foreign substance attached to the cleaning roller 101 and mixing the impurity such as the foreign substance with the cleaning liquid 108 in the liquid tank 109. Consequently, the purity level of the cleaning liquid decreases, but the circulation of the cleaning liquid is held. Accordingly, the filter 111 collects uncleanness owing to the impurity such as the foreign substance when the cleaning liquid flows out of the liquid tank 109. As a result, the purity level of the cleaning liquid can be held satisfactorily.

It is possible to always maintain a satisfactory state by thus circulating the cleaning liquid while cleaning the transfer member 2 continuously by the cleaning roller 101.

Figure 11B:
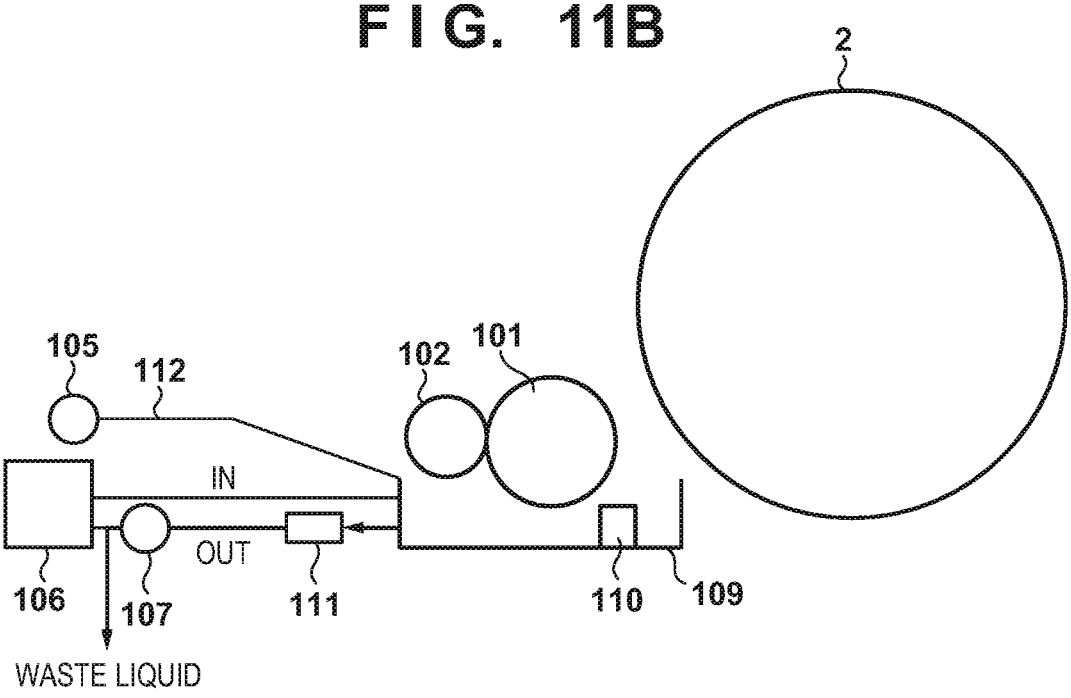

When the printing operation ends, and the printing system 1 is stopped, the cleaning roller 101 is separated from the transfer member 2, and rotations of the transfer member 2 and cleaning roller 101 are also stopped, as shown in FIG. 11B. On the other hand, supply of the cleaning liquid from the liquid supply unit 105 is also stopped, and the cleaning liquid reserved in the liquid tank 109 is exhausted as a waste liquid. The cleaning liquid is exhausted as the waste liquid and withdrawn from the fluid channel of the circulation channel by switching the three-way valve (V) 114 from the normal state to the collection state, and driving the pump 107.

When the cleaning liquid is exhausted from the liquid tank 109 and the circulation channel as described above, the cleaning unit 5D returns to an initial state as shown in FIG. 10A.

Note that the collected liquid may be returned to the liquid supply unit 105 to be reused instead of discarding it as the waste liquid to the waste liquid tank 115. The cleaning liquid during circulation is maintained in a state with less impurity by the filter 111, and thus it is also sufficiently possible to reuse the collected cleaning liquid.

According to the above-described embodiment, under the liquid level of the liquid tank where a part of the cleaning roller is immersed, the blot on the surface of the cleaning roller immersed in the cleaning liquid is removed by the contact member such as the brush. In a cleaning operation of the transfer member, the blot attached to the surface of the cleaning roller is scraped off highly efficiently while dissolving the blot in the cleaning liquid of the liquid tank. As a result, cleaning performance of the cleaning roller can be increased greatly, also contributing to an improvement in throughput of the entire printing apparatus.

Cleaning of the cleaning roller itself and application of the cleaning liquid to the cleaning roller are performed in one liquid tank, making it possible to downsize the cleaning unit. In addition, a cleaning liquid in a good state is supplied from the liquid tank to the cleaning roller by filtering and performing temperature adjustment while circulating the cleaning liquid for the cleaning roller of the liquid tank. This also increases the cleaning performance of the cleaning roller.

In the above embodiment, the print unit 3 includes the plurality of printheads 30. However, a form may include only one printhead 30. The printhead 30 need not be a full-line head but may be of a serial type that forms an ink image by discharging ink from the printhead 30 while moving the printhead 30 in the Y direction.

A conveyance mechanism of the print medium P may adopt another method such as a method of clipping and conveying the print medium P by the pair of rollers. In the method of conveying the print medium P by the pair of rollers or the like, a roll sheet may be used as the print medium P, and a printed product P' may be formed by cutting the roll sheet after transfer.

In the above embodiment, the transfer member 2 is provided on the outer peripheral surface of the transfer drum 41. However, another method such as a method of forming a transfer member 2 into an endless swath and running it cyclically may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-136443, filed Jul. 12, 2017, which is hereby incorporated by reference herein in its entirety.

What is claimed is:

1. A printing apparatus comprising:

a transfer member that rotates cyclically;

a printhead configured to form an image on the transfer member;

a transfer unit configured to perform a transfer operation in which the image formed on the transfer member is transferred to a print medium;

a cleaning roller, which rotates in contact with the moving transfer member, for cleaning the transfer member after the transfer operation by the transfer unit and before a next image is formed by the printhead;

a liquid container configured to reserve a cleaning liquid so that a part of the cleaning roller is immersed in the cleaning liquid; and a removal unit configured to remove an impurity by contacting a surface of the cleaning roller which rotates in the liquid container.

2. The apparatus according to claim 1, wherein the removal unit includes a member which contacts the cleaning roller in the cleaning liquid.

3. The apparatus according to claim 1, further comprising a circulation unit configured to circulate the cleaning liquid between the liquid container and an outside of the liquid container.

4. The apparatus according to claim 3, wherein the circulation unit includes at least one of a temperature adjustment unit configured to adjust a temperature of the cleaning liquid and a filter configured to remove uncleanness contained in the cleaning liquid.

5. The apparatus according to claim 4, wherein the circulation unit includes:

a first fluid channel configured to cause the cleaning liquid to flow out;

a second fluid channel configured to cause the cleaning liquid to flow into the liquid container; and a pump configured to generate a flow of the cleaning liquid in a circulation channel that includes the first fluid channel and the second fluid channel, the filter and the temperature adjustment unit being provided in the circulation channel.

6. The apparatus according to claim 5, further comprising a collection unit configured to collect the cleaning liquid from the liquid container and the circulation channel.

7. The apparatus according to claim 6, further comprising a supply unit configured to supply a new cleaning liquid to the liquid container.

8. The apparatus according to claim 7, wherein the collection unit returns the collected cleaning liquid to the supply unit for reuse.

9. The apparatus according to claim 1, wherein the cleaning roller includes a porous member in an outer peripheral portion, and an amount of the cleaning liquid contained in the cleaning roller is adjusted by changing a pressure at which a driven roller which contacts the cleaning roller presses the porous member.

10. The apparatus according to claim 1, wherein the cleaning roller can contact the transfer member and be separated from the transfer member, and the cleaning roller is spaced apart from the transfer member when the printing apparatus is stopped, and the cleaning roller is in contact with the transfer member during a printing operation of the printing apparatus.

11. The apparatus according to claim 1, wherein the cleaning roller rotates such that a moving direction of the cleaning roller is reversed with respect to a moving direction of the transfer member in a contact portion between the transfer member and the cleaning roller.

12. The apparatus according to claim 1, wherein the transfer member is a rotating transfer drum, and a plurality of printheads are arranged radially along a cylindrical surface of the transfer drum.

13. A printing apparatus comprising:

a transfer member that rotates cyclically;

a printhead configured to form an image on the transfer member;

a transfer unit configured to perform a transfer operation in which the image formed on the transfer member is transferred to a print medium;

a cleaning roller, which rotates in contact with the moving transfer member, for cleaning the transfer member after the transfer operation by the transfer unit and before a next image is formed by the printhead; and a removal unit configured to remove an impurity by contacting a surface of the cleaning roller which rotates.

* * * * *